US008789299B2

(12) United States Patent
Hoffman et al.

(10) Patent No.: US 8,789,299 B2
(45) Date of Patent: Jul. 29, 2014

(54) THIN INTERNALLY ILLUMINATED SIGN

(75) Inventors: Joseph A. Hoffman, Minneapolis, MN (US); Ellen O. Aeling, Oakdale, MN (US); Michael A. Meis, Stillwater, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 554 days.

(21) Appl. No.: 11/914,565

(22) PCT Filed: May 19, 2006

(86) PCT No.: PCT/US2006/019516

§ 371 (c)(1),
(2), (4) Date: Jun. 19, 2008

(87) PCT Pub. No.: WO2006/125174

PCT Pub. Date: Nov. 23, 2006

(65) Prior Publication Data

US 2009/0211130 A1 Aug. 27, 2009

Related U.S. Application Data

(60) Provisional application No. 60/682,579, filed on May 19, 2005.

(51) Int. Cl.
*G09F 13/04* (2006.01)

(52) U.S. Cl.
USPC ..... 40/564; 40/540

(58) Field of Classification Search
USPC ..... 362/612, 621, 632, 623, 624, 362, 97.1, 362/97.3, 97.4, 634, 812; 40/564, 570, 579, 40/580; 257/98, E33.07
See application file for complete search history.

(56) References Cited

U.S. PATENT DOCUMENTS

| | | | | |
|---|---|---|---|---|
| 3,694,945 | A * | 10/1972 | Detiker | 40/615 |
| 5,388,357 | A | 2/1995 | Malita | |
| 5,954,423 | A * | 9/1999 | Logan et al. | 362/235 |
| 6,080,467 | A | 6/2000 | Weber et al. | |
| 6,497,946 | B1 | 12/2002 | Kretman et al. | |
| 6,579,606 | B1 | 6/2003 | Uchiya et al. | |
| 6,607,286 | B2 * | 8/2003 | West et al. | 362/255 |
| 6,674,096 | B2 | 1/2004 | Sommers | |
| 6,883,932 | B2 * | 4/2005 | Pan et al. | 362/225 |
| 6,964,507 | B2 * | 11/2005 | Mohacsi | 362/545 |
| 7,229,194 | B2 * | 6/2007 | Liu et al. | 362/225 |
| 7,651,234 | B2 * | 1/2010 | Lim | 362/97.3 |
| 2005/0018414 | A1 | 1/2005 | Tsai et al. | |
| 2007/0236937 | A1 * | 10/2007 | Chao et al. | 362/327 |
| 2009/0056183 | A1 * | 3/2009 | Reiland et al. | 40/564 |

FOREIGN PATENT DOCUMENTS

| | | |
|---|---|---|
| DE | 3931668 | 12/1994 |
| GB | 2 405 543 | 3/2005 |

(Continued)

*Primary Examiner* — Casandra Davis
(74) *Attorney, Agent, or Firm* — Steven A. Bern; Jay R. Pralle; Colene H. Blank

(57) ABSTRACT

An internally illuminated sign includes a case at least partially lined with highly reflective layer and a display surface. The sign also includes light sources that emit light in directions approximately parallel to the display surface.

15 Claims, 6 Drawing Sheets

(56) References Cited

FOREIGN PATENT DOCUMENTS

| | | | | |
|---|---|---|---|---|
| JP | 10-082916 | | | 3/1998 |
| JP | 20030067225 | A | * | 3/2003 |
| KR | 10-2003-0067225 | | | 8/2003 |
| KR | 10-2005-0022820 | | | 3/2005 |
| KR | 10-2005-0022954 | | | 3/2005 |
| KR | 2005022820 | A | * | 3/2005 |
| WO | WO 03/010738 | | | 2/2003 |
| WO | WO 2005/067570 | | | 7/2005 |

* cited by examiner

THIN INTERNALLY ILLUMINATED SIGN

BACKGROUND

Internally illuminated signs are used for many purposes. Some internally illuminated signs show only simple text. Examples of such signs are signs that display words such as "EXIT" OR "OPEN". Other signs, especially signs used in advertising, will typically include graphical images as well as text. Typically, such signs are illuminated by fluorescent tubes inside the signs. It is important that such signs have uniform illumination. It has been discovered that the ratio of the distance between the center of one tube and the center of the adjacent tube to the distance from the center of any of the tubes to the front surface of the sign should be no greater than 2:1. When this ratio is greater the regions directly in front of the tubes will be perceived by a viewer as being brighter than other regions of the sign.

An alternative type of sign when text is to be displayed is a neon sign. Neon signs are advantageous because they may be made bright with very high contrast so that they catch the attention of the viewer. A disadvantage of neon lighting, however, is that it is fragile and easily broken. A further disadvantage of neon is that each neon tube must be made of custom blown glass. Another disadvantage of neon lighting is that it requires high operating voltages.

Fluorescent and neon light sources can be categorized as linear light sources. Yet another type of sign is lit using point light sources. One type of point light source rapidly being adopted by the sign industry is the LED. LEDs have numerous advantages over the latter two types. They are low voltage, consume less power, are more robust and demonstrate very long life requiring fewer bulb changes. When using such point sources of light, however, it is especially difficult to maintain proper illumination uniformity.

DETAIL DESCRIPTION

Figure 1:
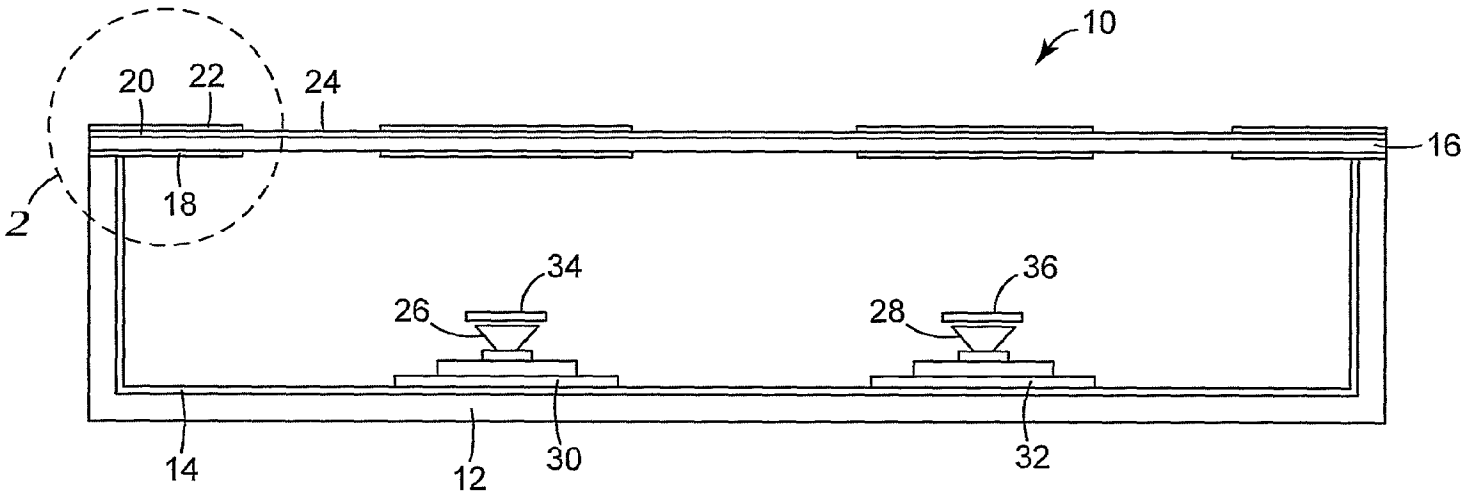
FIG. 1 is a side view of a first embodiment of the invention.

FIG. 1 shows an internally illuminated sign according to the invention, generally designated 10. Internally illuminated sign includes a case 12. Case 12 is at least partially lined with a highly reflective material 14. Highly reflective material 14 may be either diffusely or specularly reflective. Examples of material that may be used for highly reflective material 14 are any reflective paint, typically, although not limited to, white paint, Light Enhancement Film (LEF), commercially available from 3M Company of St. Paul, Minn. and the reflector described in U.S. Pat. No. 6,497,946, the teaching of which is incorporated herein by reference. An example of a specular reflector that may be used as highly reflective film 14 is the film described in U.S. Pat. No. 6,080,467, the teaching of which is incorporated herein by reference. An example of a film as taught by U.S. Pat. No. 6,080,467 is available from 3M Company of St. Paul, Minn. under the name Enhanced Specular Reflector (ESR). A highly reflective specular reflector such as ESR could be made a diffuse reflector by depositing diffusely reflecting materials such as titanium dioxide on it. Alternatively a highly reflective specular reflector such as ESR could be made diffusely reflective by coating a diffusing material on it. U.S. Pat. No. 6,579,606, the teaching of which is incorporated herein by reference, teaches coating hollow glass beads in a (meth)acrylic binder to make a specular reflector act as a diffusing reflector. Solid glass beads or polymer beads could also be used with the same or other binders. Although generally all surfaces will use the same highly reflective material, different materials could be used on different surfaces or even on different portions of a particular surface. A combination of specular and diffuse reflecting materials may also be used. In some embodiments, highly reflective means that more than 50% of the light striking the reflector is reflected. In other embodiments highly reflective will mean that at least 88%, 95% or 99% of light striking the reflector is reflected.

On one side of case 12 is a cover assembly that forms a display surface. The cover assembly includes a transparent substrate 16. On the inside of illuminated sign 10, the cover assembly includes a highly reflective material 18. Typically, highly reflective material 18 will be the same material as highly reflective layer 14. Alternatively, highly reflective layer 18 could be printed on transparent substrate 16, for example, by screen printing or dot matrix printing. Printing techniques are particularly desirable for use when a graphic image is to be displayed. This allows the user to vary the density of dots to correspond to light and dark portions of the image.

As shown, a colored diffusing layer 20 lies on the outside of transparent layer 16, although the colored diffusing layer 20 could be placed on the inside of transparent substrate 16 as well. If diffusing layer 20 is rigid enough to be self-supporting, transparent substrate 16 could be eliminated altogether. In this case, diffusing layer 20 serves as the substrate. Alternatively, if a diffuse output is not desired, diffusing layer 20 could be eliminated.

External to diffusing layer 20 and transparent substrate 16 is an opaque layer 22. Although opaque layer 22 is optional, it is often desired in order to provide differentiation in color from diffusive layer 20.

Highly reflective layer 18 and opaque layer 22 do not cover the entirety of the front of internally illuminated sign 10. Instead, apertures such as aperture 24 are provided in order to provide the desired indicia on the sign. It is desirable to have the openings in highly reflective layer 18 and opaque layer 22 aligned to form apertures 24. For maximum efficiency highly reflective layer 18 could cover all of the display surface except for the output apertures such as output aperture 24.

Figure 2:
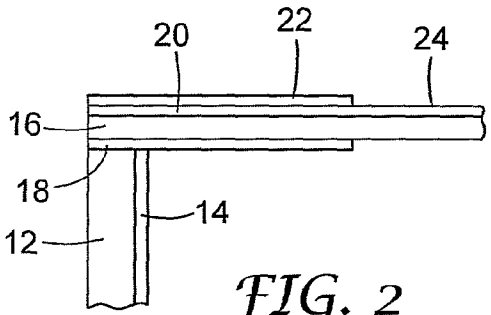
FIG. 2 is a detail of a portion of FIG. 1.

FIG. 2 is an enlarged view of the portion of internally illuminated sign 10 shown in detail 2 of FIG. 1. FIG. 2 more clearly shows highly reflective material 18, diffusive layer 20 and opaque layer 22.

Figure 6:
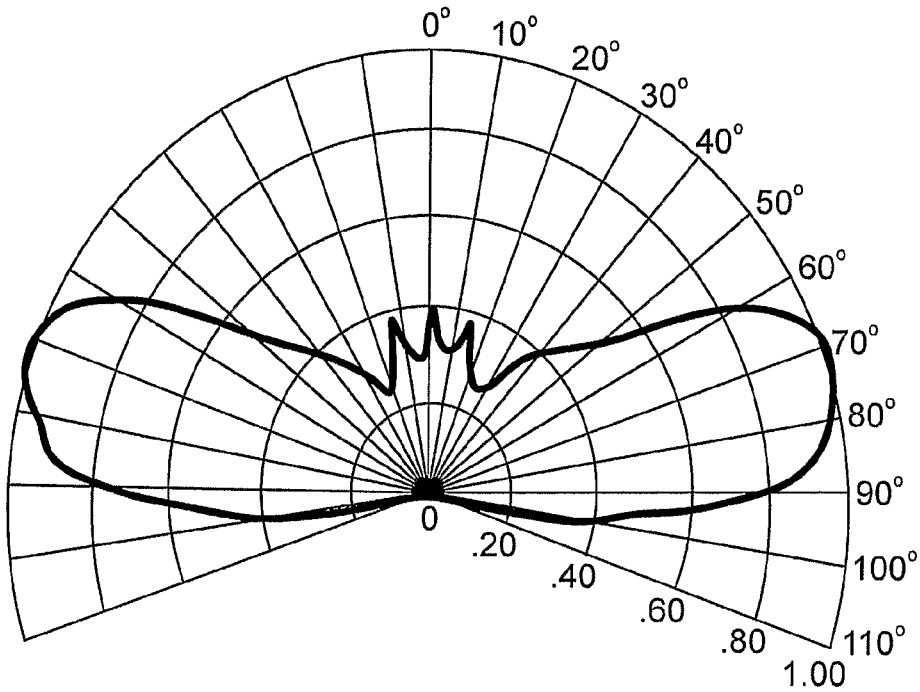
FIG. 6 is a polar plot of a cross section of the light output of a side emitting LED.

Returning to FIG. 1, light is provided in internally illuminated sign 10 by light sources 26 and 28 mounted on a side of case 12 opposing the display surface. Light sources 26 and 28 are point sources and emit light primarily in directions approximately parallel to the display surface of internally illuminated sign 10 such that substantially all of the light emitted must be reflected at least once before escaping from internally illuminated sign 10. By requiring such reflection the uniformity of illumination is greatly improved while permitting internally illuminated sign 10 to be much thinner than would be possible using prior art designs. One light source that works particularly well for this purpose is an edge or side emitting LED. An edge emitting LED emits light primarily to its side around the entire 360 degree circumference. The light is emitted over a range of angles of approximately 50 to 100 degrees to the normal. One LED that works well with the invention is the Luxeon V Star side emitting LED available from Lumileds Lighting, LLC of San Jose, Calif. A polar plot of a cross section of the light output of such an LED is shown in FIG. 6.

LED's 26 and 28 are mounted on thermally conductive substrates to dissipate heat. As shown, the light sources are mounted on separate heat sinks 30 and 32 respectively. Alternatively the thermal conductive substrates could be portions of case 12.

Optionally, reflective layers 34 and 36 may be placed on top of light sources 26 and 28 to prevent any stray light that may be emitted towards the front of internally illuminated sign 10 from proceeding directly to the front and the output aperture creating undesirable bright spots.

Figure 3:
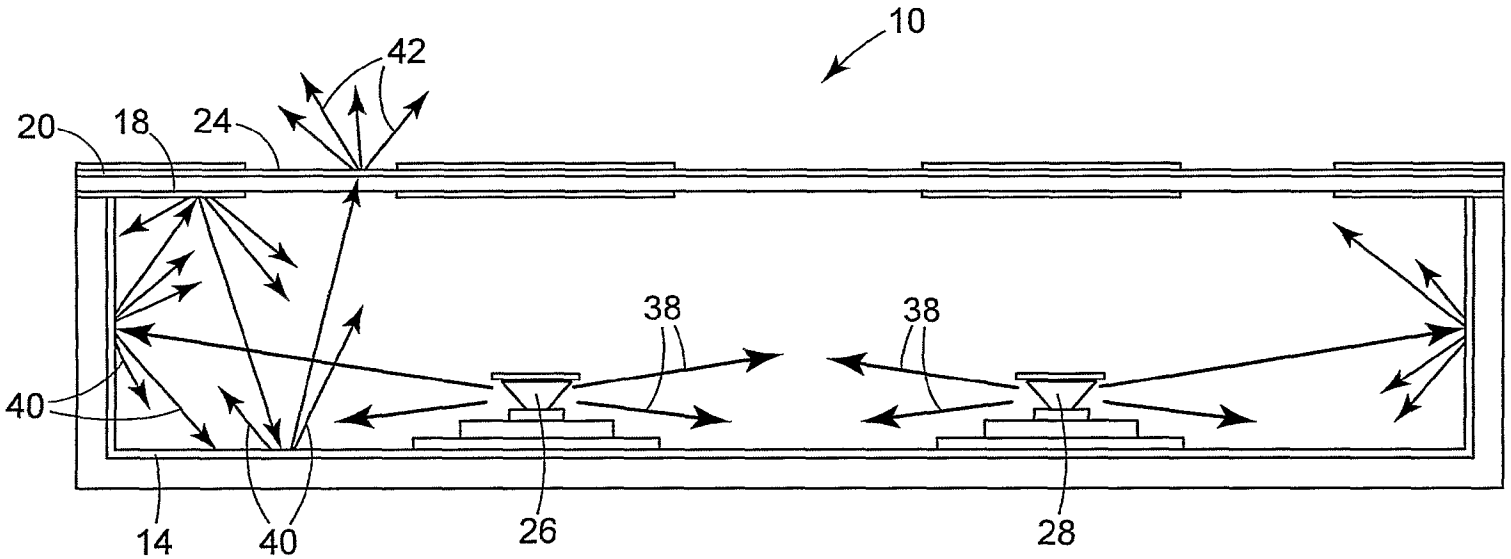
FIG. 3 is a side view of the embodiment of FIG. 1 showing light paths.

FIG. 3 shows internally illuminated sign 10. Light 38 is emitted by light emitters 26 and 28 over a relatively narrow range of angles. When light 38 strikes highly reflective surfaces 14 and 18 it is reflected and scattered. If surfaces 14 and 18 are diffusely reflecting surfaces the light is diffused and reflected in many directions as shown as light rays 40 in FIG. 3. As previously stated, highly reflective materials 14 and 18 may be diffusely reflective or may be specularly reflective or a combination of the two. Diffusely reflective materials provide the advantage of providing higher mixing of the light to promote uniformity. However, specularly reflecting materials are available with higher reflectivity than are diffusely reflecting materials. Thus, the choice of specular reflection or diffuse reflection will be, in part, dependent upon the application. In either case, as explained above, light will generally be reflected at least once prior to escaping from internally illuminated sign 10.

When the light strikes aperture 24 it escapes from the internally illuminated sign. Diffusing material 20 will cause the light to be further scattered and broadly visible. A desired color for the indicia of the sign may be provided by making diffusing layer 20 a colored diffuser and making light sources 26 and 28 sources of white light, by making diffusing layer 20 white and making light sources 26 and 28 sources of colored light, or by making diffusing layer 20 colored and making light sources 26 and 28 sources of colored light. In another embodiment, substrate 16 may be colored rather than strictly transparent and diffusing layer 20 may be colored or color neutral. In this latter embodiment the light sources may also be either colored or color neutral. Of course, if, in the desired embodiment, the indicia should be white, substrate 16, diffusing layer 20 and the light sources may all be color neutral.

Figure 4:
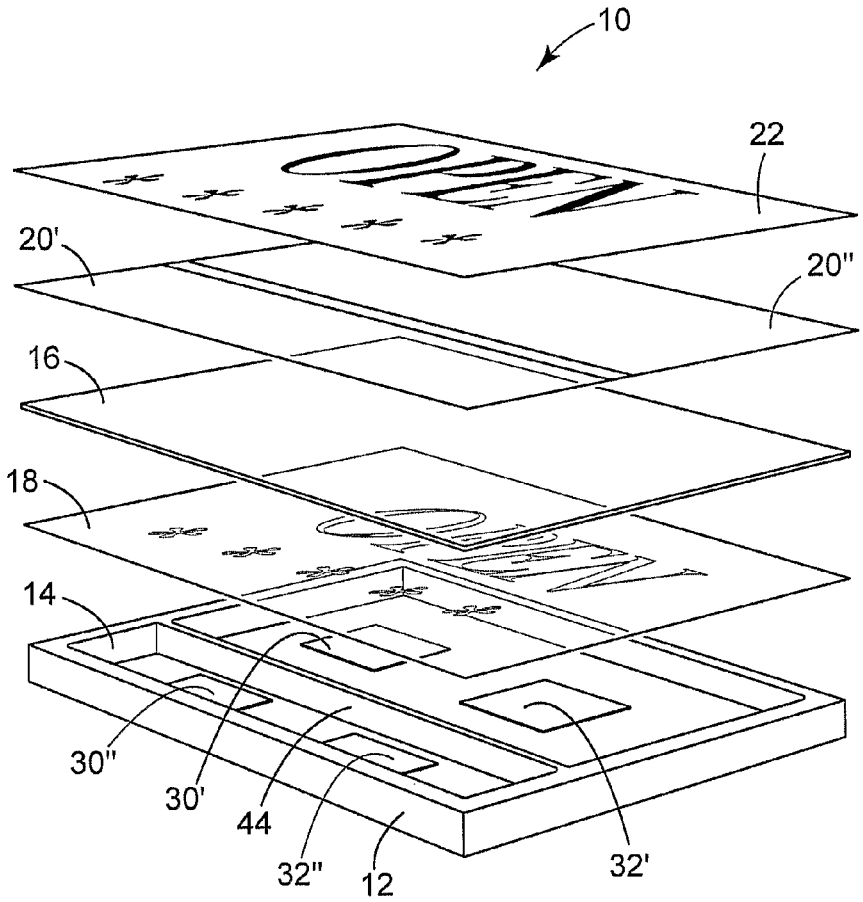
FIG. 4 is an exploded view of an embodiment of the invention.

FIG. 4 is an exploded view of the internally illuminated sign 10 according to the invention. FIG. 4 includes case 12 lined with highly reflective material 14. FIG. 4 further shows transparent substrate 16 highly reflective layer 18 and opaque layer 22.

Internally illuminated sign 10 of FIG. 4 is intended to have indicia in two different colors. Therefore diffusing layer 20 of FIG. 1 has been divided into two sections, 20' and 20", having different colors. In this example section 20' illuminates a sign displaying the word "OPEN" and section 20" illuminates a section displaying a line of asterisks. The interior of internally illuminated sign 10 of FIG. 4 includes heat sinks 30', 30", 32' and 32". Light sources 26 and 28 of FIG. 1 would normally be mounted on these heat sinks but are omitted in FIG. 4 in order to simplify the drawing. Internally illuminated sign 10 of FIG. 4 further includes a wall 44 dividing the interior of internally illuminated sign 10 into two separate compartments. One compartment contains heat sinks 30' and 32' while the other contains heat sinks 30" and 32". The light sources associated with heat sink 30'and 32' would be the color that is intended to be displayed or the word "OPEN" on the indicia while the light sources associated with heat sink 30"and 32" would be the color to be associated with the line of asterisks. Alternatively, all of the light sources could be the same color, typically white, and wall 44 could be omitted.

Figure 5:
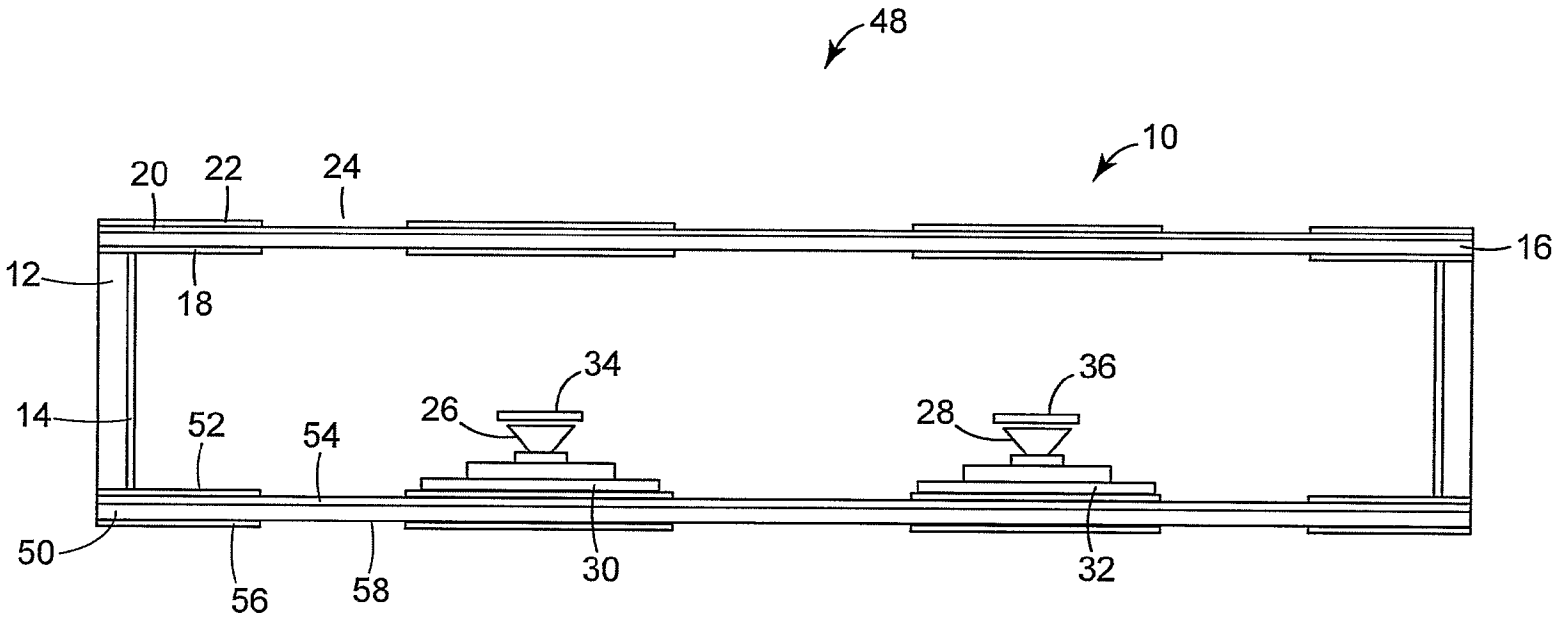
FIG. 5 is a side view of another embodiment of the invention.

FIG. 5 illustrates another embodiment of the invention designated generally 48. Internally illuminated sign 48 includes a second transparent substrate 50 and an additional highly reflective layer 52 a diffusing layer 54 and an opaque layer 56. This way, internally illuminated sign 48 is able to provide indicia on both sides as indicated by aperture 58. Alternatively, apertures 24 could be omitted and all apertures of internally illuminated sign 48 could be on the same side of case 12 as the light sources. As in previously described embodiments light is emitted from LED's 26 and 28 in directions approximately parallel so that substantially all or all of it will be reflected at least once before escaping from internally illuminated sign 10.

Figure 7:
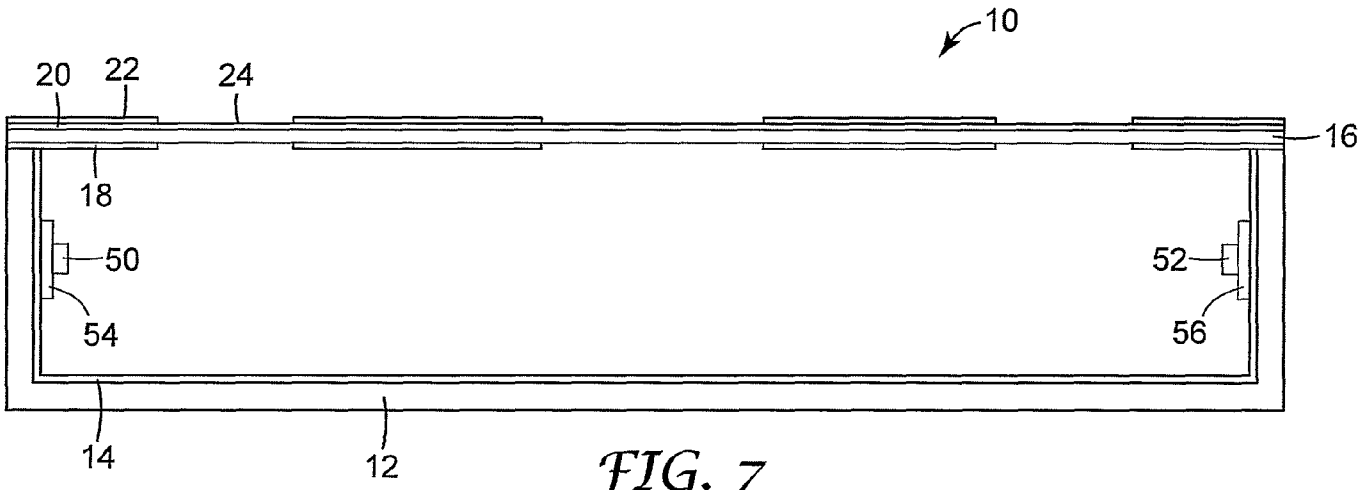
FIG. 7 is a side view of another embodiment of the invention.

FIG. 7 illustrates another embodiment of the invention in which top emitting LED's are utilized. LED's 50 and 52 are mounted on heat sinks 54 and 56 respectively. LED's 50 and 52 are point sources of light that emit light in a direction approximately parallel to the output surface of internally illuminated sign 10 such that the substantially all of the light they emit will be reflected at least once before escaping from internally illuminated sign 10.

Figure 8A:
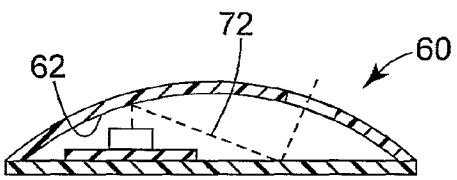
FIG. 8*a* is a side view of the embodiment of FIG. 8 showing an illustrative light path.
Figure 8:
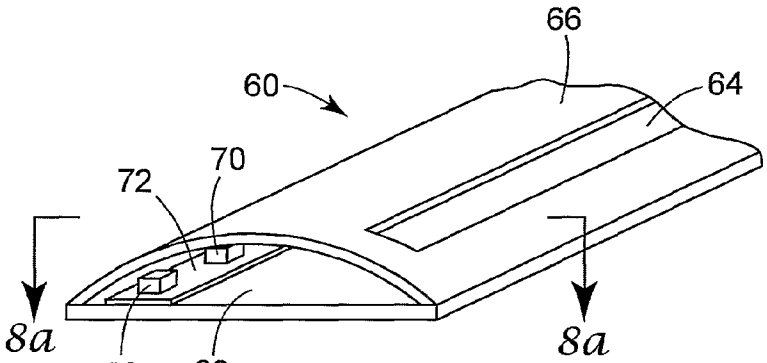
FIG. 8 is a perspective view of still another embodiment of the invention.

FIG. 8 illustrates another embodiment of the invention. According to the embodiment of FIG. 8, internally illuminated sign 60 is a low profile strip that could be used for decorative purposes or to delineate walkways in darkened areas such as movie theaters. Internally illuminated sign 60 has an inner surface 62 that is at least partially covered with a highly reflective material. As in the previous embodiments, the highly reflective material could be either diffusely reflective or specularly reflective. Internally illuminated sign 60 includes an aperture or output window 64 on a display surface 66. LED's such as LED's 68 and 70 are mounted on a heat sink 72. Unlike the previous embodiments LED's 68 and 70 do not emit light parallel to output surface 66, but rather toward it. However, the light is directed to a portion of display surface 66 separated from output window 64 such that the light must be reflected at least once by inner surface 62 before escaping internally illuminated sign 60. Generally it is preferred that the portion of output surface 66 to which light from LED's 68 and 70 is directed is covered with highly reflective material. This is shown more clearly in FIG. 8*a* in which illustrative light ray 72 is reflected by inner surface 62 twice before reaching aperture 64 and escaping from internally illuminated sign 60.

The term low profile refers to the thickness of the sign; or to state it another way, it is the distance from the mounting surface of the sign to the greatest dimension measured normal to the mounting surface. In one embodiment a low profile sign will have a thickness no greater than 6 cm. In another embodiment that thickness is no greater than 3 cm. In still another embodiment the thickness does not exceed 1 cm. Practically, the realistic limit to the minimum profile can is governed by the need to maintain some reasonable light transmissible gap between the top light emitting surface of the LED (or LEDs) and the first reflective surface.

What is claimed is:

1. An internally illuminated sign comprising:

a case comprising an inner surface that is at least partially lined with a diffusely reflective material;

a display surface comprising at least one output aperture, wherein a portion of the display surface is lined with a highly reflective material; and at least one side emitting light emitting diode (LED) positioned to emit light in a direction approximately parallel to the display surface such that substantially all of the light emitted must be reflected at least once before escaping from the internally illuminated sign through the at least one output aperture, wherein the at least one side emitting LED is mounted on a side of the case opposing the display surface.

2. The internally illuminated sign of claim 1 wherein all of the display surface except for the at least one output aperture is lined with highly reflective material.

3. The internally illuminated sign of claim 1 further comprising a reflective material positioned adjacent the at least one side emitting LED to prevent stray light from reaching the at least one output aperture directly.

4. The internally illuminated sign of claim 1, wherein the diffusely reflective material that at least partially lines the inner surface of the case comprises a highly reflective specular reflector comprising a diffuse coating.

5. The internally illuminated sign of claim 1, further comprising a cover assembly that forms the display surface, wherein the cover assembly comprises an opaque layer and a colored diffusing layer positioned between the opaque layer and the highly reflective material that lines the portion of the display surface, wherein the at least one output aperture is formed through the opaque layer and the highly reflective material.

6. The internally illuminated sign of claim 5, wherein the cover assembly further comprises a transparent substrate, wherein the highly reflective material is positioned on an inner surface of the transparent substrate facing the at least one side emitting LED, and the opaque layer and colored diffusing layer are positioned on an outer surface of the transparent substrate.

7. The internally illuminated sign of claim 1, wherein the side of the case opposing the display surface comprises at least one output aperture.

8. The internally illuminated sign of claim 7, wherein the side of the case opposing the display surface further comprises a colored diffusing layer and an opaque layer, wherein the at least one output aperture of the side of the case opposing the display surface is formed through the diffusely reflective material that at least partially lines the inner surface of the case and the opaque layer.

9. An internally illuminated sign comprising:

a case comprising an inner surface that is at least partially lined with a diffusely reflective material;

a display surface comprising at least one output aperture, wherein a portion of the display surface is lined with a diffusely reflective material; and at least one side emitting LED positioned to emit light in a direction such that substantially all of the emitted light is reflected at least once by the inner surface before the light escapes from the internally illuminated sign through the at least one output aperture, wherein the at least one side emitting LED is mounted on a side of the case opposing the display surface, wherein all of the display surface except for the at least one output aperture is lined with the diffusely reflective material.

10. The internally illuminated sign of claim 9 further comprising a reflective material positioned adjacent the at least one side emitting LED to prevent stray light from reaching the at least one output aperture directly.

11. The internally illuminated sign of claim 9, wherein the diffusely reflective material that at least partially lines the inner surface of the case comprises a highly reflective specular reflector comprising a diffuse coating.

12. The internally illuminated sign of claim 9, further comprising a cover assembly that forms the display surface, wherein the cover assembly comprises an opaque layer and a colored diffusing layer positioned between the opaque layer and the diffusely reflective material that lines the portion of the display surface, wherein the at least one output aperture is formed through the opaque layer and the diffusely reflective material.

13. The internally illuminated sign of claim 12, wherein the cover assembly further comprises a transparent substrate, wherein the diffusely reflective material is positioned on an inner surface of the transparent substrate facing the at least one side emitting LED, and the opaque layer and colored diffusing layer are positioned on an outer surface of the transparent substrate.

14. The internally illuminated sign of claim 9, wherein the side of the case opposing the display surface comprises at least one output aperture.

15. The internally illuminated sign of claim 14, wherein the side of the case opposing the display surface further comprises a colored diffusing layer and an opaque layer, wherein the at least one output aperture of the side of the case opposing the display surface is formed through the diffusely reflective material that at least partially lines the inner surface of the case and the opaque layer.

* * * * *